US011519107B2

(12) United States Patent
Peng et al.

(10) Patent No.: US 11,519,107 B2
(45) Date of Patent: Dec. 6, 2022

(54) FIBER SPREADING APPARATUS

(71) Applicant: Industrial Technology Research Institute, Hsinchu (TW)

(72) Inventors: Chih-Kang Peng, Miaoli County (TW); Shih-Ming Chen, Hsinchu (TW); Yu-Cheng Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 364 days.

(21) Appl. No.: 16/729,508

(22) Filed: Dec. 30, 2019

(65) Prior Publication Data

US 2021/0156054 A1 May 27, 2021

(30) Foreign Application Priority Data

Nov. 22, 2019 (TW) ..... 108142510

(51) Int. Cl.
*D02J 1/18* (2006.01)
*D01D 11/02* (2006.01)

(52) U.S. Cl.
CPC ..... *D02J 1/18* (2013.01); *D01D 11/02* (2013.01)

(58) Field of Classification Search
CPC ..... D02J 1/18; D02J 1/20; D02J 1/229; D02J 11/00; D01D 11/02; D02G 1/16; D02G 1/162; D02G 1/165; D02G 1/168; D10B 2101/12; B65H 51/005; B65H 51/01
USPC ..... 28/282, 283
See application file for complete search history.

(56) References Cited

U.S. PATENT DOCUMENTS 3,017,309 A * 1/1962 Crawford ..... A24D 3/022 28/282
3,095,343 A * 6/1963 Berger ..... A24D 3/0233 28/283
3,255,506 A * 6/1966 Fritz ..... B01D 39/18 28/282
3,840,941 A * 10/1974 Neveu ..... D04H 3/009 28/282
4,179,776 A * 12/1979 Wortman ..... D04H 3/02 28/282
5,042,122 A 8/1991 Iyer et al.
(Continued)

FOREIGN PATENT DOCUMENTS

CN 101818397 9/2010
CN 102439206 5/2012
(Continued)

OTHER PUBLICATIONS

"Office Action of China Counterpart Application", dated May 25, 2022, p. 1-p. 8.
(Continued)

*Primary Examiner* — Amy Vanatta
(74) *Attorney, Agent, or Firm* — JCIPRNET

(57) ABSTRACT

A fiber spreading apparatus which is configured to spread a carbon fiber bundle, and includes a feeding roll, a winding roll, a vibrating roller, and a first nozzle. The vibrating roller is disposed between the feeding roll and the winding roll, and is in contact with the carbon fiber bundle. The vibrating roller is rotated according to an axis of rotation, and is vibrated along a vibrating direction perpendicular to the axis of rotation. The first nozzle is disposed between the vibrating roller and the winding roll, and blows the carbon fiber bundle.

10 Claims, 6 Drawing Sheets

(56) References Cited

U.S. PATENT DOCUMENTS

| | | | | |
|---|---|---|---|---|
| 6,032,342 | A * | 3/2000 | Kawabe | D04H 1/48 226/97.4 |
| 6,094,791 | A | 8/2000 | Akase et al. | |
| 6,743,392 | B2 | 6/2004 | Tanaka et al. | |
| 9,003,619 | B2 | 4/2015 | Kawabe | |
| 9,185,969 | B2 | 11/2015 | Takahashi et al. | |
| 9,206,534 | B2 | 12/2015 | Yamashita et al. | |
| 9,828,702 | B2 * | 11/2017 | Kawabe | D04H 3/04 |
| 2003/0057585 | A1 | 3/2003 | Tanaka et al. | |
| 2006/0137156 | A1 * | 6/2006 | Kawabe | D02J 1/18 28/271 |
| 2009/0271960 | A1 * | 11/2009 | Kawabe | D02J 1/18 28/283 |
| 2012/0135227 | A1 | 5/2012 | Kawabe | |
| 2015/0345050 | A1 | 12/2015 | Wilson et al. | |
| 2017/0037545 | A1 * | 2/2017 | Keppel | D02J 1/18 |
| 2017/0305077 | A1 * | 10/2017 | Nakai | B29C 65/7894 |

FOREIGN PATENT DOCUMENTS

| | | | | |
|---|---|---|---|---|
| CN | 105121720 | | 12/2015 | |
| CN | 105624873 | A * | 6/2016 | B32B 5/024 |
| CN | 106435909 | | 2/2017 | |
| CN | 106536800 | | 3/2017 | |
| CN | 211713318 | | 10/2020 | |
| CN | 112172276 | A * | 1/2021 | B32B 5/024 |
| JP | 2004225222 | | 8/2004 | |
| TW | 201718977 | | 6/2017 | |
| TW | I595137 | | 8/2017 | |
| TW | M594022 | | 4/2020 | |
| WO | 2016114239 | | 7/2016 | |

OTHER PUBLICATIONS

"Office Action of Taiwan Counterpart Application", dated Nov. 4, 2020, p. 1-p. 8.

* cited by examiner

FIBER SPREADING APPARATUS

CROSS-REFERENCE TO RELATED APPLICATION

This application claims the priority benefit of Taiwan application serial no. 108142510, filed on Nov. 22, 2019. The entirety of the above-mentioned patent application is hereby incorporated by reference herein and made a part of this specification.

TECHNICAL FIELD

The disclosure relates to a fiber spreading apparatus, and more particularly to a fiber spreading apparatus applied to carbon fiber.

BACKGROUND

Carbon fiber is a composite material with characteristics of high strength (tensile strength) and high modulus (tensile modulus), and carbon fiber has the advantage of being lighter than metal or alloy materials and is therefore gradually adopted in various industries such as sports industry, medical industry, aerospace industry, electronics industry, military industry, or civilian production industry. A carbon fiber bundle is composed of a plurality of fibers. In practical applications, the carbon fiber bundle must be first subjected to a fiber spreading treatment to form a carbon fiber cloth in order to achieve objects such as reduced thickness and increased cover area. Then, the surface of a workpiece is covered with the carbon fiber cloth to reinforce the structural strength of the workpiece.

Specifically, the larger the spread area of the carbon fiber bundle, the smaller the thickness of the carbon fiber cloth produced, and accordingly, the lighter the weight of the carbon fiber cloth per unit area. Because the workpiece to be reinforced is covered with a plurality of layers of carbon fiber cloth on the surface thereof, under the same cover thickness configuration, the thinner the carbon fiber cloth, the more layers of carbon fiber cloth are covered on the surface of the workpiece, and therefore the better the reinforcing quality of the workpiece. Therefore, how to improve the spread uniformity and spread width of the carbon fiber bundle and achieve objects such as reduced thickness and increased cover area is the main project that industries have continuously researched and developed.

SUMMARY

An embodiment of the disclosure provides a fiber spreading apparatus for spreading a carbon fiber bundle. A vibrating roller is disposed between a feeding roll and a winding roll and is in contact with the carbon fiber bundle. The vibrating roller is rotated around an axis of rotation and vibrates along a vibrating direction perpendicular to the axis of rotation. A first nozzle is disposed between the vibrating roller and the winding roll and blows the carbon fiber bundle.

A detailed description is given in the following embodiments with reference to the accompanying drawings.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION

Figure 1A:
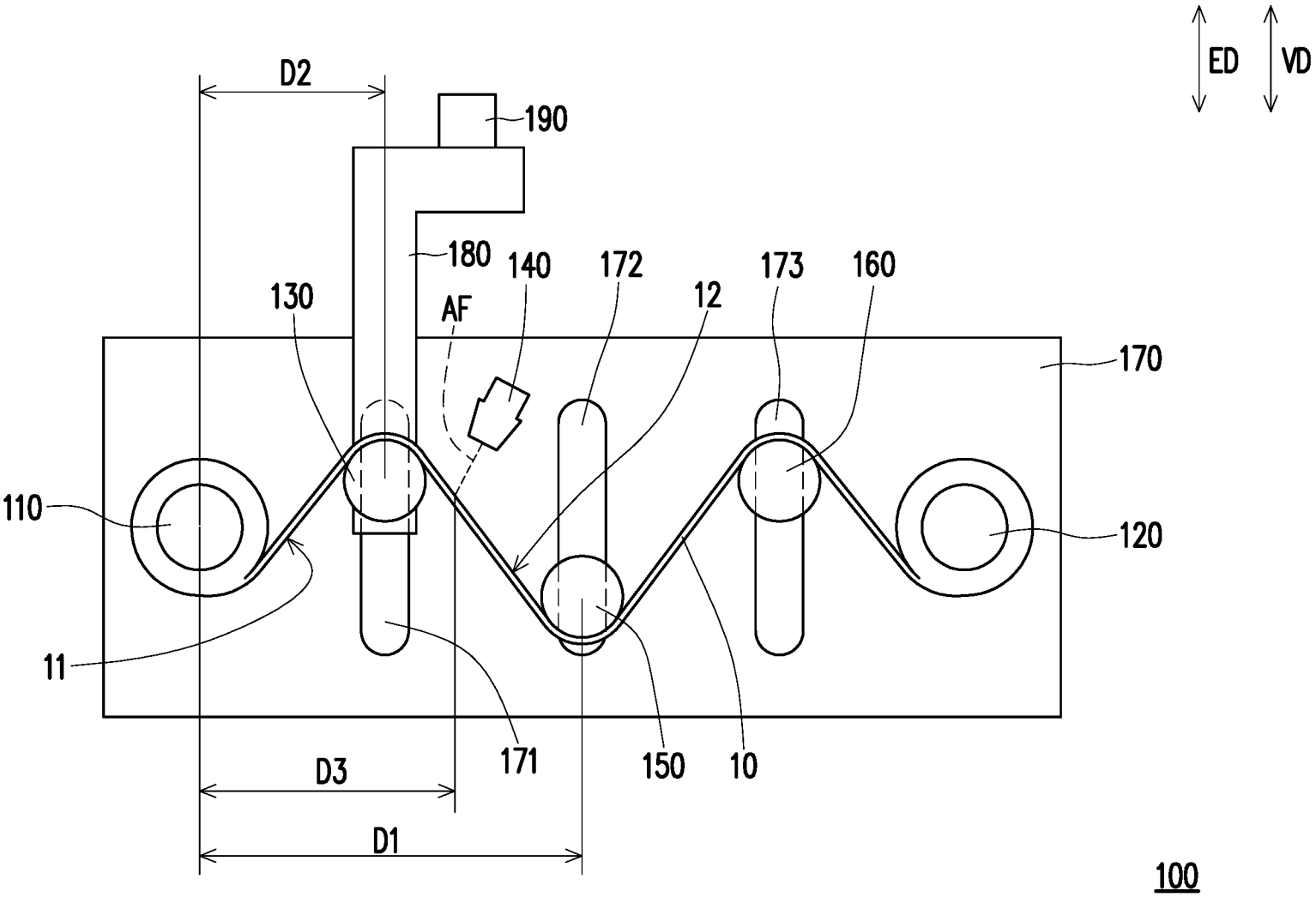
FIG. 1A is a schematic of a fiber spreading apparatus of the first embodiment of the disclosure.
Figure 1B:
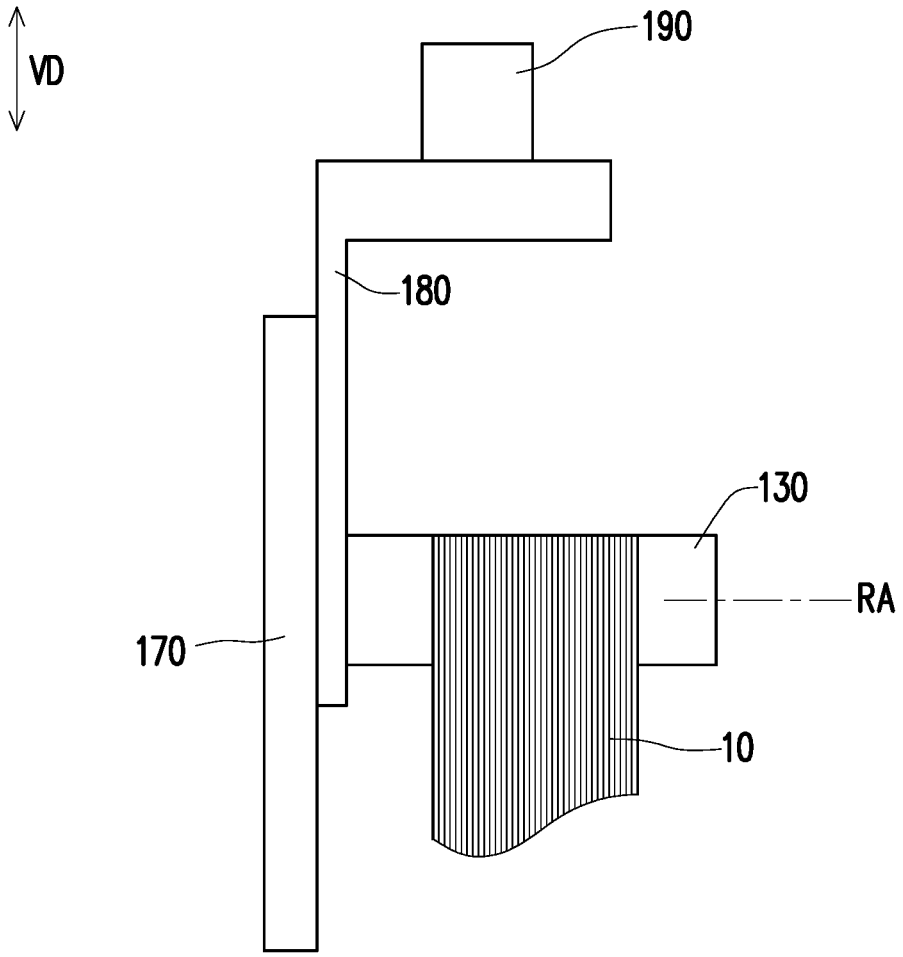
FIG. 1B is a partially enlarged schematic of a vibrator, a carrier, a vibrating roller, and a platform of FIG. 1A from another viewing angle.

FIG. 1A is a schematic of a fiber spreading apparatus of the first embodiment of the disclosure. FIG. 1B is a partially enlarged schematic of a vibrator, a carrier, a vibrating roller, and a platform of FIG. 1A from another viewing angle. Referring to FIG. 1A and FIG. 1B, in the present embodiment, a fiber spreading apparatus 100 includes a feeding roll 110 and a winding roll 120, wherein the feeding roll 110 is configured to output a carbon fiber bundle 10 toward the side at which the winding roll 120 is located, and a carbon fiber cloth formed after a fiber spreading treatment is wound by the winding roll 120. For example, the feeding roll 110 and the winding roll 120 may be active reels to provide the power needed to transport the carbon fiber bundle 10.

Specifically, the fiber spreading apparatus 100 further includes a vibrating roller 130 and a first nozzle 140, wherein the vibrating roller 130 and the first nozzle 140 are disposed between the feeding roll 110 and the winding roll 120, and the first nozzle 140 is disposed between the vibrating roller 130 and the winding roll 120. In other words, after the carbon fiber bundle 10 is outputted from the feeding roll 110, the carbon fiber bundle 10 is first transported through the vibrating roller 130, then transported through the first nozzle 140, and lastly the carbon fiber cloth formed by spreading the carbon fiber bundle 10 is wound by the winding roll 120.

In the present embodiment, the vibrating roller 130 is in contact with the carbon fiber bundle 10, and the first nozzle 140 blows the carbon fiber bundle 10. Further, the carbon fiber bundle 10 has a first surface 11 and a second surface 12 opposite to the first surface 11, wherein the vibrating roller 130 is in contact with the first surface 11 of the carbon fiber bundle 10, and the first nozzle 140 blows the second surface 12 of the carbon fiber bundle 10. That is, the vibrating roller 130 and the first nozzle 140 are respectively located at both sides of the carbon fiber bundle 10.

Moreover, the fiber spreading apparatus 100 further includes an auxiliary roller, wherein the auxiliary roller may include a first auxiliary roller 150 and a second auxiliary roller 160, and the first auxiliary roller 150 and the second auxiliary roller 160 are disposed between the vibrating roller 130 and the winding roll 120. On the transport path of the carbon fiber bundle 10, the vibrating roller 130, the first nozzle 140, the first auxiliary roller 150, and the second auxiliary roller 160 are sequentially arranged. In detail, the vibrating roller 130 is in contact with the first surface 11 of the carbon fiber bundle 10, the first auxiliary roller 150 is in contact with the second surface 12 of the carbon fiber bundle 10, and the second auxiliary roller 160 is in contact with the first surface 11 of the carbon fiber bundle 10. Under the configuration of the contact relationship, the tension of the carbon fiber bundle 10 during transportation may be maintained to avoid the situation in which the carbon fiber bundle 10 is relaxed.

In other embodiments, the number of the auxiliary roller may be increased or decreased according to actual design requirements. For example, if the distance between the feeding roll and the vibrating roller is longer, an auxiliary roller may be added between the feeding roll and the vibrating roller to help transport the carbon fiber bundle and maintain the tension of the carbon fiber bundle during transportation. If the distance between the feeding roll and the winding roll is shorter, then under the premise of sufficiently maintaining the tension of the carbon fiber bundle 10 during transportation, an auxiliary roller may be omitted between the feeding roll and the vibrating roller or between the vibrating roller and the winding roll.

In the present embodiment, the fiber spreading apparatus 100 further includes a platform 170, wherein the feeding roll 110, the winding roll 120, the vibrating roller 130, the first nozzle 140, the first auxiliary roll 150, and the second auxiliary roller 160 are disposed on the platform 170, and the feeding roll 110, the winding roll 120, the vibrating roller 130, the first auxiliary roller 150, and the second auxiliary roller 160 have a degree of freedom of rotation movement relative to the platform 170. For example, there are height differences between the feeding roll 110, the winding roll 120, the vibrating roller 130, the first auxiliary roller 150, and the second auxiliary roller 160, and the heights of the feeding roll 110, the winding roll 120, the vibrating roller 130, the first auxiliary roller 150, and the second auxiliary roller 160 on the platform 170 may be adjusted according to actual conditions, so as to improve the smoothness of transportation of the carbon fiber bundle 10 and maintain the tension of the carbon fiber bundle 10 during transportation.

As shown in FIG. 1, the platform 170 has a first sliding groove 171, a second sliding groove 172, and a third sliding groove 173, wherein the first sliding groove 171, the second sliding groove 172, and the third sliding groove 173 are sequentially arranged between the feeding roll 110 and the winding roll 120, and the first sliding groove 171, the second sliding groove 172, and the third sliding groove 173 are parallel to one another. In detail, the vibrating roller 130 is provided corresponding to the first sliding groove 171 to adjust the height thereof on the platform 170 via the guidance of the first sliding groove 171. The first auxiliary roller 150 is slidably connected to the second sliding groove 172 to adjust the height thereof on the platform 170 via the guidance of the second sliding groove 172. The second auxiliary roller 160 is slidably connected to the third sliding groove 173 to adjust the height thereof on the platform 170 via the guidance of the third sliding groove 173.

Moreover, the position of the vibrating roller 130 in the first sliding groove 171, the position of the first auxiliary roller 150 in the second sliding groove 172, and the position of the second auxiliary roller 160 in the third sliding groove 173 may be fixed by locking, snapping, magnetic attraction, or other applicable positioning mechanisms. It should be noted that the vibrating stroke of the vibrating roller 130 is not affected by the positioning mechanism.

Figure 2:
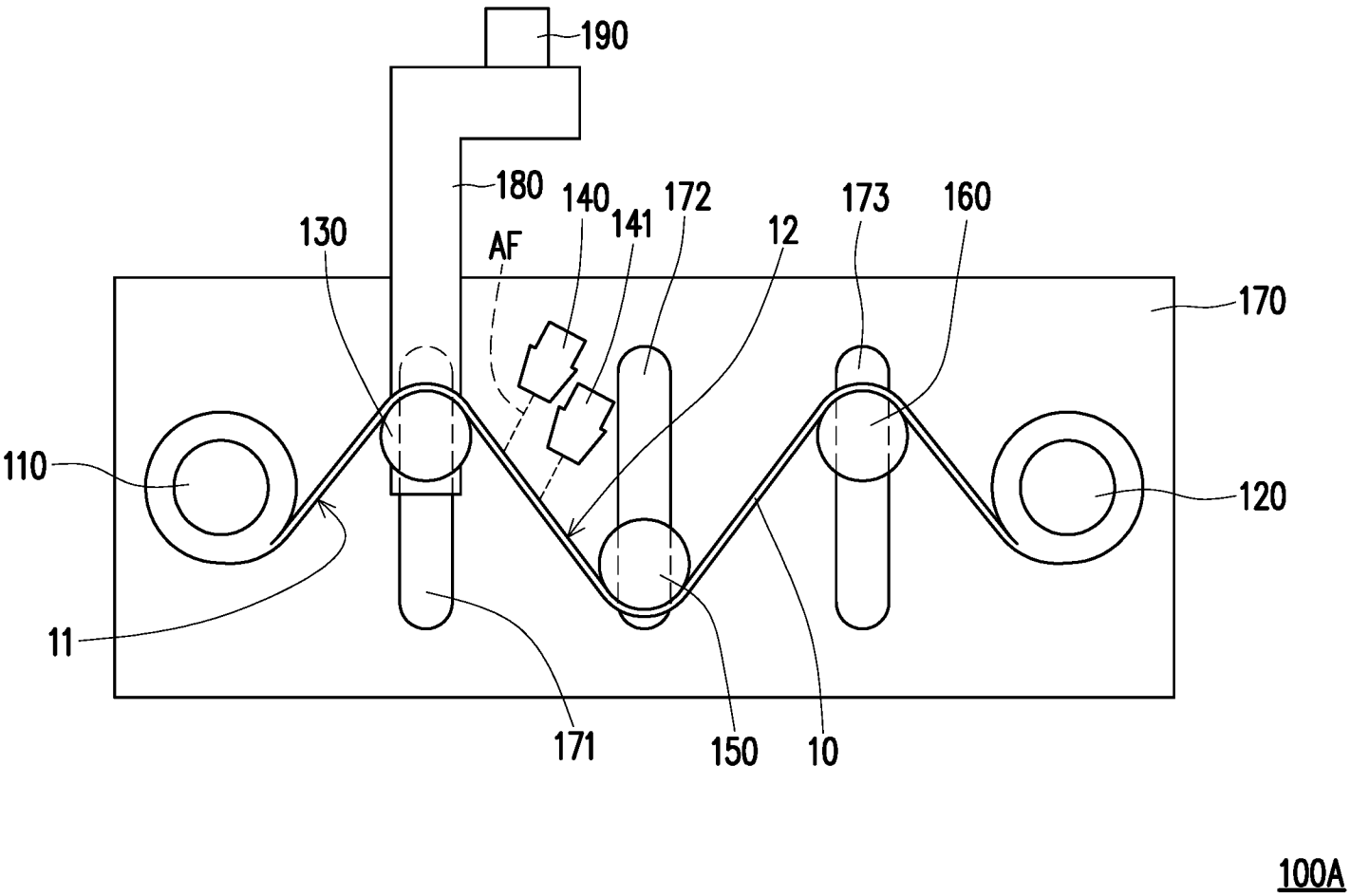
FIG. 2 is a schematic of a fiber spreading apparatus of the second embodiment of the disclosure.

Please refer to FIG. 1 and FIG. 2. In the present embodiment, the fiber spreading apparatus 100 further includes a carrier 180 and a vibrator 190 disposed on the carrier 180, wherein the carrier 180 is slidably disposed on the carrier 170 and slidably connected to the first sliding groove 171, and the vibrating roller 130 is pivotally disposed on the carrier 180. The vibrator 190 may adopt a pneumatic, hydraulic, or gas-liquid vibration mechanism to drive the carrier 180 and the vibrating roller 130 to vibrate in a reciprocating manner in a vibrating direction VD. The vibrating roller 130 is slidably connected to the first sliding groove 171 via the carrier 180, and the position of the carrier 180 in the first sliding groove 171 may be fixed by locking, snapping, magnetic attraction, or other applicable positioning mechanisms without affecting the vibrating stroke of the carrier 180 and the vibrating roller 130. Since the carrier 180 is slidably connected to the first sliding groove 171, the vibrating direction VD of the carrier 180 and the vibrating roller 130 is parallel to an extending direction ED of the first sliding groove 171. In other words, the first sliding groove 171 may be configured to determine the vibrating direction VD of the carrier 180 and the vibrating roller 130.

Moreover, the vibrating roller 130 is configured to be rotated around an axis of rotation RA, and the vibrating direction VD of the carrier 180 and the vibrating roller 130 is perpendicular to the axis of rotation RA. In detail, the vibration of the vibrating roller 130 is configured to slightly loosen or slightly spread the carbon fiber bundle 10, and the direction of loosening or spreading of the carbon fiber bundle 10 may be parallel to the axis of rotation RA. In the transport path of the carbon fiber bundle 10, the first nozzle 140 is located between the vibrating roller 130 and the first auxiliary roller 150, and the first nozzle 140 is configured to blow the carbon fiber bundle 10 transported between the vibrating roller 130 and the first auxiliary roller 150, wherein the vibrating roller 130 is in contact with the first surface 11 of the carbon fiber bundle 10, and the first nozzle 140 blows the second surface 12 of the carbon fiber bundle 10. Based on the blowing direction of an airflow AF of the first nozzle 140, the carbon fiber bundle 10 may still be in contact with the vibrating roller 130 when the first nozzle 140 blows the carbon fiber bundle 10. Since the carbon fiber bundle 10 is slightly loosened or slightly expanded by the vibration of the vibrating roller 130, after the carbon fiber bundle 10 is blown by the airflow AF of the first nozzle 140, the carbon fiber bundle 10 may be evenly expanded to form a carbon fiber cloth.

Taking the application of 12K carbon fiber bundle to the fiber spreading apparatus 100 as an example, the spread width of the 12K carbon fiber bundle is substantially between 12 mm and 28 mm. Taking the application of 24K carbon fiber bundle to the fiber spreading apparatus 100 as an example, the spread width of the 24K carbon fiber bundle is substantially between 25 mm and 33 mm. In other words, via the fiber spreading mechanism of vibrating first then blowing, the spread uniformity and spread width of the carbon fiber bundle 10 after the fiber spreading process of the fiber spreading apparatus 100 are improved, and objects such as reduced thickness of the carbon fiber cloth and increased cover area of the carbon fiber cloth are achieved.

Please refer to FIG. 1. In the present embodiment, the first auxiliary roller 150 is a first distance D1 from the feeding roll 110, and the vibrating roller 130 is a second distance D2 from the feeding roll 110. Moreover, the position at which the airflow AF blown by the first nozzle 140 falls on the carbon fiber bundle 10 is a third distance D3 from the feeding roll 110, and the position at which the airflow AF blown by the first nozzle 140 falls on the carbon fiber bundle 10 is closer to the vibrating roller 130 so that the carbon fiber bundle 10 vibrated by the vibrating roller 130 may be instantly blown by the airflow AF to spread to prevent the carbon fiber bundle 10 from condensing again.

In detail, the first distance D1 is greater than the third distance D3, and the third distance D3 is greater than the second distance D2. The ratio of the second distance D2 and the first distance D1 is between 0.92 and 0.95 and the ratio of the third distance D3 and the first distance D1 is between 0.93 and 0.98. Moreover, the number of strokes per minute (spm) of the vibrating roller 130 is between 5000 times and 25000 times, and the vibrating stroke of the vibrating roller 130 is between 0.3 mm and 3 mm. In conjunction with the distance configuration, vibration frequency configuration, amplitude configuration, and configuration of the blowing position, the fiber spreading apparatus 100 may make the carbon fiber bundle 10 spread evenly to obtain a better fiber spreading effect.

Specifically, the first distance D1 is the shortest distance or horizontal distance between the axis of the feeding roll 110 and the axis of the first auxiliary roller 150, and the second distance D2 is the shortest distance or horizontal distance between the axis of the feeding roll 110 and the axis of the vibrating roller 130. Moreover, the third distance D3 is the shortest distance or horizontal distance between the axis of the feeding roll 110 and the point at which the airflow AF blown from the first nozzle 140 falls on the carbon fiber bundle 10.

Moreover, a first angle is between the blowing direction of the first nozzle 140 and the second surface 12 of the carbon fiber bundle 10 and is between about 60 degrees and 85 degrees. A second angle is between the blowing direction of the first nozzle 140 and the vibrating direction VD of the vibrating roller 130 and is between about 70 degrees and 100 degrees. Based on the configuration of the first angle and the second angle, the fiber spreading effect when the first nozzle 140 blows the carbon fiber bundle 10 is improved.

Other embodiments are listed below. The same or similar design principles and technical effects are not repeated, and mainly the differences between the embodiments are introduced.

FIG. 2 is a schematic of a fiber spreading apparatus of the second embodiment of the disclosure. Referring to FIG. 2, compared to the fiber spreading apparatus 100 of the first embodiment, a fiber spreading apparatus 100A of the present embodiment further includes a second nozzle 141 on the transport path of the carbon fiber bundle 10, the second nozzle 141 is located between the first nozzle 140 and the winding roll 120, and the first nozzle 140 is located between the vibrating roller 130 and the second nozzle 141. Further, on the transport path of the carbon fiber bundle 10, the second nozzle 141 is located between the first nozzle 140 and the first auxiliary roller 150. The first nozzle 140 and the second nozzle 141 blow the carbon fiber bundle 10 in sequence, which helps to improve the fiber spreading effect of the carbon fiber bundle 10.

Figure 3:
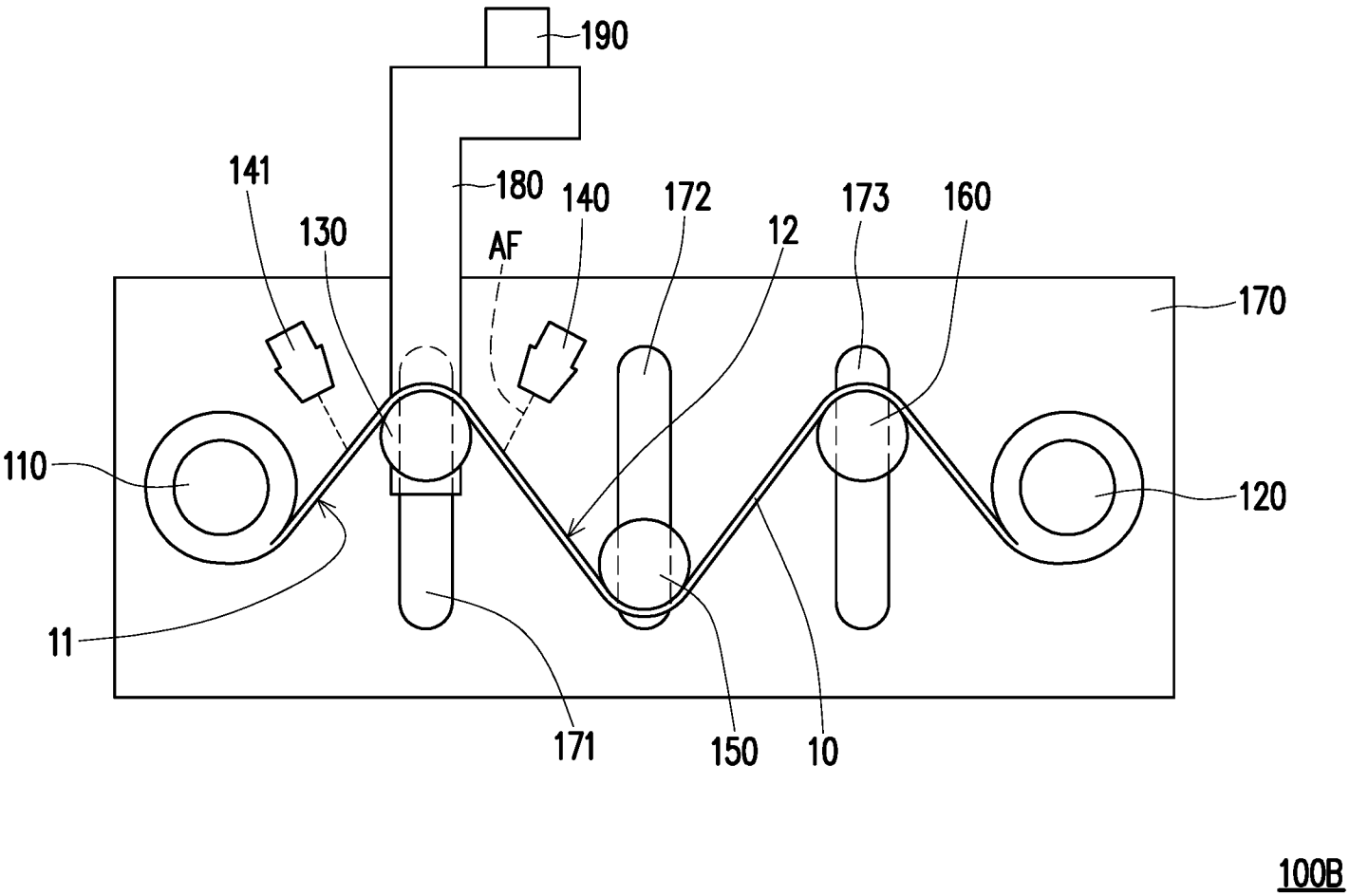
FIG. 3 is a schematic of a fiber spreading apparatus of the third embodiment of the disclosure.

FIG. 3 is a schematic of a fiber spreading apparatus of the third embodiment of the disclosure. Referring to FIG. 3, compared to the fiber spreading apparatus 100 of the first embodiment, a fiber spreading apparatus 100B of the present embodiment further includes the second nozzle 141 on the transport path of the carbon fiber bundle 10, the second nozzle 141 is disposed between the feeding roll 110 and the vibrating roller 130, and the vibrating roller 130 is located between the second nozzle 141 and the first nozzle 140. Therefore, before the carbon fiber bundle 10 is vibrated by the vibrating roller 130, the second nozzle 141 first blows the carbon fiber bundle 10 to make the carbon fiber bundle 10 slightly loosened or slightly expanded. Next, the carbon fiber bundle 10 is vibrated via the vibrating roller 130. After that, the carbon fiber bundle 10 is blown via the first nozzle 140. Based on the fiber spreading mechanism, the fiber spreading apparatus 100B allows the carbon fiber bundle 10 to be evenly spread to obtain a better fiber spreading effect.

Figure 4:
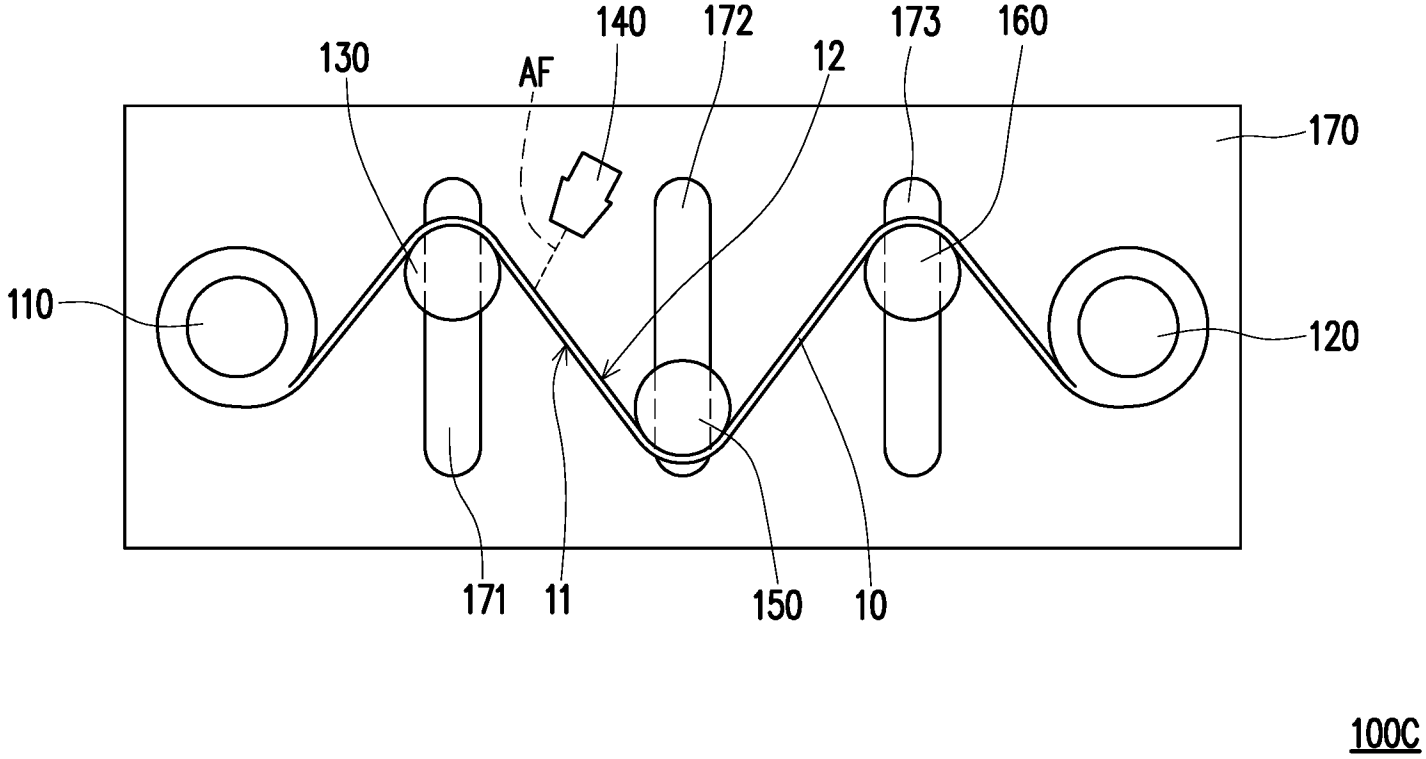
FIG. 4 is a schematic of a fiber spreading apparatus of the fourth embodiment of the disclosure.

FIG. 4 is a schematic of a fiber spreading apparatus of the fourth embodiment of the disclosure. Please refer to FIG. 4. Compared to the fiber spreading apparatus 100 of the first embodiment, a fiber spreading apparatus 100C of the present embodiment does not have the carrier 180 and the vibrator 190 shown in FIG. 1A, and a pneumatic, hydraulic, or gas-liquid vibration mechanism and the like may be built in or integrated in the vibrating roller 130.

Figure 5:
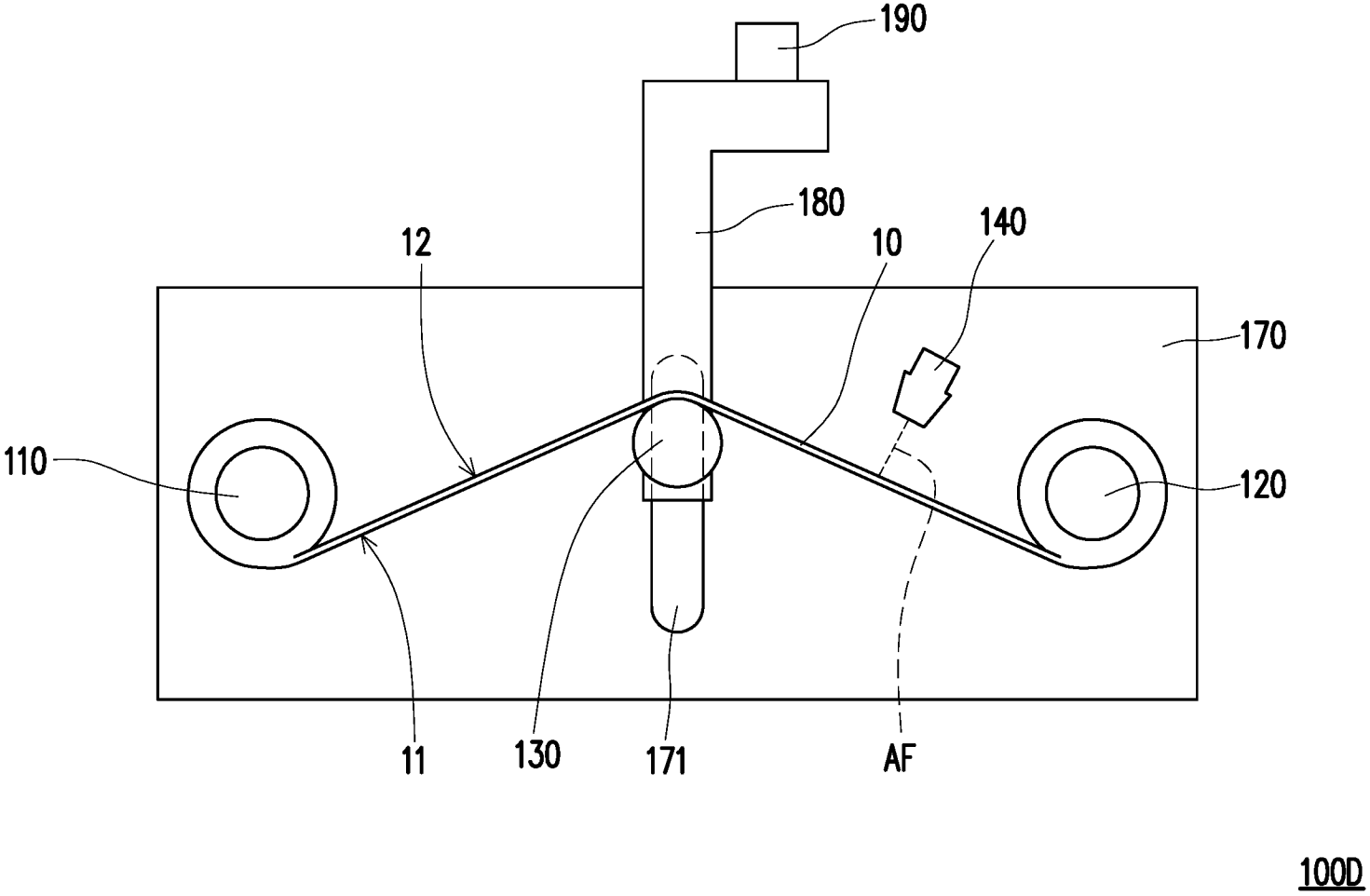
FIG. 5 is a schematic of a fiber spreading apparatus of the fifth embodiment of the disclosure.

FIG. 5 is a schematic of a fiber spreading apparatus of the fifth embodiment of the disclosure. Referring to FIG. 5, compared to the fiber spreading apparatus 100 of the first embodiment, a fiber spreading apparatus 100D of the present embodiment does not have the first auxiliary roller 150 and the second auxiliary roller 160 shown in FIG. 1A.

Based on the above, the fiber spreading apparatus of an embodiment of the disclosure adopts a fiber spreading mechanism of vibrating first then blowing, and the vibrating direction of the vibrating roller is perpendicular to the axis of rotation of the vibrating roller. Accordingly, the spread uniformity and spread width of the carbon fiber bundle subjected to the fiber spreading treatment of the fiber spreading apparatus of an embodiment of the disclosure are improved, and objects such as reduced thickness of the carbon fiber cloth and increased cover area of the carbon fiber cloth are achieved.

While the disclosure has been described by way of example and in terms of the exemplary embodiments, it should be understood that the disclosure is not limited thereto. On the contrary, it will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A fiber spreading apparatus configured to spread a carbon fiber bundle, the fiber spreading apparatus comprising:

a feeding roll;

a winding roll;

a vibrating roller disposed between the feeding roll and the winding roll, and the vibrating roller is in contact with the carbon fiber bundle, wherein the vibrating roller is rotated according to an axis of rotation, and the vibrating roller is vibrated along a vibrating direction perpendicular to the axis of rotation;

a first nozzle disposed between the vibrating roller and the winding roll and blowing the carbon fiber bundle;

a platform, wherein the feeding roll, the winding roll, the vibrating roller, and the first nozzle are disposed on the platform;

a carrier slidably disposed on the platform; and a vibrator provided on the carrier, wherein the vibrating roller is pivotally disposed on the carrier.

2. The fiber spreading apparatus of claim 1, further comprising an auxiliary roller, wherein the auxiliary roller is disposed between the vibrating roller and the winding roll, and the auxiliary roller is in contact with the carbon fiber bundle.

3. The fiber spreading apparatus of claim 2, wherein the first nozzle is located between the vibrating roller and the auxiliary roller, the carbon fiber bundle has a first surface and a second surface opposite to the first surface, the vibrating roller is in contact with the first surface, the auxiliary roller is in contact with the second surface, and the first nozzle blows the second surface.

4. The fiber spreading apparatus of claim 2, wherein the auxiliary roller is a first distance from the feeding roll, the vibrating roller is a second distance from the feeding roll, and a ratio of the second distance and the first distance is between 0.92 and 0.95.

5. The fiber spreading apparatus of claim 4, wherein a position at which an airflow blown from the first nozzle falls on the carbon fiber bundle is a third distance from e feeding roll, and a ratio of the third distance and the first distance is between 0.93 and 0.98.

6. The fiber spreading apparatus of claim 1, wherein the platform has a sliding groove, the carrier is slidably connected to the sliding groove, and an extending direction of the sliding groove is parallel to the vibrating direction.

7. The fiber spreading apparatus of claim 1, further comprising a second nozzle, wherein the second nozzle is located between the first nozzle and the winding roll, and the first nozzle is located between the vibrating roller and the second nozzle.

8. The fiber spreading apparatus of claim 1, further comprising a second nozzle, wherein the second nozzle is disposed between the feeding roll and the vibrating roller, and the vibrating roller is located between the second nozzle and the first nozzle.

9. The fiber spreading apparatus of claim 1, wherein a number of strokes per minute of the vibrating roller is between 5000 times and 25000 times.

10. The fiber spreading apparatus of claim 1, wherein a vibrating stroke of the vibrating roller is between 0.3 mm and 3 mm.

* * * * *